US005878704A

United States Patent [19]

Schebitz et al.

[11] Patent Number: 5,878,704

[45] Date of Patent: Mar. 9, 1999

[54] ELECTROMAGNETIC ACTUATOR, INCLUDING SOUND MUFFLING MEANS, FOR OPERATING A CYLINDER VALVE

[75] Inventors: Michael Schebitz, Eschweiler; Franz Pischinger, Aachen, both of Germany

[73] Assignee: FEV Motorentechnik GmbH & Co. KG, Aachen, Germany

[21] Appl. No.: 993,712

[22] Filed: Dec. 18, 1997

[30] Foreign Application Priority Data

Jan. 4, 1997 [DE] Germany ..... 297 00 096 U
Feb. 27, 1997 [DE] Germany ..... 197 07 885.0

[51] Int. Cl.[6] ..... F01L 9/04

[52] U.S. Cl. ..... 123/90.11; 251/129.01; 251/129.16; 335/257

[58] Field of Search ..... 123/90.11; 251/129.01, 251/129.15, 129.16, 129.1; 335/247, 248, 257, 271, 277

[56] References Cited

U.S. PATENT DOCUMENTS

| | | | |
|---|---|---|---|
| 4,455,543 | 6/1984 | Pischinger et al. | 335/266 |
| 4,477,789 | 10/1984 | Karlow | 335/257 |
| 4,515,343 | 5/1985 | Pischinger et al. | 123/90.11 |
| 5,010,923 | 4/1991 | Kouda et al. | 251/129.02 |
| 5,146,196 | 9/1992 | Frank | 335/257 |
| 5,223,812 | 6/1993 | Kreuter | 251/129.1 |
| 5,372,228 | 12/1994 | VanLaningham et al. | 335/271 |

*Primary Examiner*—Weilun Lo
*Attorney, Agent, or Firm*—Venable; Gabor J. Kelemen

[57] ABSTRACT

An electromagnetic actuator, particularly for operating a cylinder valve of an internal-combustion engine, includes an electromagnet for generating an attracting electromagnetic force; an armature movable into contact with and away from the electromagnet; a spring arrangement connected to the armature and opposing the electromagnetic force; and a sound muffling device attached to the electromagnet for reducing sound transmission by body vibration from the electromagnet.

12 Claims, 3 Drawing Sheets

ELECTROMAGNETIC ACTUATOR, INCLUDING SOUND MUFFLING MEANS, FOR OPERATING A CYLINDER VALVE

CROSS REFERENCE TO RELATED APPLICATION

This application claims the priority of German Application Nos. 297 00 096.9 filed Jan. 4, 1997 and 197 07 885.0 filed Feb. 27, 1997, which are incorporated herein by reference.

BACKGROUND OF THE INVENTION

Electromagnetically operated actuators include at least one electromagnet and an armature which affects a setting member and which is connected with at least one resetting means so that, in response to the energization of the electromagnet, the armature is moved from a first setting position determined by the resetting means into a second setting position in which the armature abuts the pole face of the electromagnet. Electromagnetic actuators of this type are used, for example, for controlling the cylinder valves of a piston-type internal-combustion engine. For such an application, preferably two electromagnets are used between which the armature may be moved into the first and second setting positions back and forth against the force of the resetting means, such as a resetting spring, as the coil current of the holding electromagnet is turned off and the coil current of the capturing electromagnet is turned on. By a suitable actuation of the individual actuators of the cylinder valves, the inflow of the fluid medium into and its outflow from the cylinder may be controlled in such a manner that the work process is optimally influenced to meet any operational requirements. Electromagnetically operated actuators for cylinder valves are disclosed, for example, in U.S. Pat. No. 4,455,543.

In electromagnetic actuators of the above-outlined type the armature arrives in an abutting relationship with the pole face of the momentarily capturing electromagnet in each of the setting positions. Since for a secure capturing of the armature a minimum armature speed has to be present even as the armature reaches its end position, upon collision of the armature with the pole face of the capturing electromagnet an impact noise is generated which is not only transmitted as a sound wave to the environment but is also transmitted as a body vibration to the internal-combustion engine and, in case of vehicles, it is even transferred to the vehicle body.

SUMMARY OF THE INVENTION

It is an object of the invention to provide an improved electromagnetic actuator of the above-outlined type in which the transmission of sound by body vibration is reduced.

This object and others to become apparent as the specification progresses, are accomplished by the invention, according to which, briefly stated, the electromagnetic actuator, particularly for operating a cylinder valve of an internal-combustion engine, includes an electromagnet for generating an attracting electromagnetic force; an armature movable into contact with and away from the electromagnet; a spring arrangement connected to the armature and opposing the electromagnetic force; and a sound muffling device attached to the electromagnet for reducing sound transmission by body vibration from the electromagnet.

By providing the sound muffling means in electromagnetic actuators as outlined above, at least the sound transmission by body vibration is significantly reduced so that, if required, only screening measures against sound wave propagation through air remain to be taken. By utilizing electromagnetic actuators according to the invention for operating cylinder valves in an internal-combustion engine which serves as the vehicle power plant, a significant improvement in user comfort is achieved by virtue of sound muffling means provided in the region of the sound generation.

According to an advantageous feature of the invention, the sound muffling means is situated between the magnet block and its mount on the engine.

According to a further advantageous feature of the invention, in case of a magnet block formed of individual elements, particularly of two electromagnets, spacer members and terminal clamping members, the sound muffling means is arranged at least between the electromagnets and the terminal clamping members and further, clamping elements are provided for holding the magnet block together. This arrangement is advantageous in that the magnet block, that is, practically the entire actuator with all of its components, may be made available as a pre-manufactured structural unit, and during assembly at the cylinder head only the sound muffling means has to be inserted between the magnet block and the suitable mounting means for the actuator. As a departure from this arrangement, in an actuator composed of a plurality of individual elements, between such individual elements a plurality of sound muffling means are arranged. In this manner the superposed contact faces of the individual elements too, are isolated as far as sound wave transmission is concerned and thus the sound transmission by body vibration to the internal-combustion engine is further reduced.

According to a further advantageous feature of the invention, the sound muffling means is formed of intermediate layers made of a temperature-resistant material having rubber-elastic properties. Such intermediate layers may be stamped or cut in the exact desired shape while also taking into consideration thickness and Shore-hardness, and may be installed in a simple manner as flat elements. The sound muffling means, however, may also be one-piece shaped components.

According to a further advantageous feature of the invention, compression limiting means are provided which ensure a defined compression of the sound muffling means by the magnet-block clamping means when the magnet block is tightened. In this manner, the sound muffling means are compressed (clamped) only to a predetermined extent which is of particular significance in structural shapes in which the clamping means serve simultaneously for securing the magnet block to the engine or serve for fixing the individual elements which form the magnet block. Since the clamping means are expediently clamping bolts, the securement of the individual elements may also be effected among themselves and/or the securement of the magnet block to the engine may be effected with the tightening torque required for a firm connection without disadvantageously affecting the sound muffling means.

In accordance with yet another advantageous feature of the invention, the compression limiting means is formed by a spacer tube through which the clamping means constituted by a tightening bolt passes, and further, the spacer tube extends at a clearance from the magnet block. In this manner the spacer tube is uncoupled from the magnet block.

A further advantageous feature of the invention provides that the individual elements of the magnet block have centering means which allows a relative motion only in the direction of armature movement. Such a measure provides for an exact alignment and fixing of the individual elements with respect to one another as concerns the direction transverse to the armature displacement and thus ensures the required accuracy of the armature guidance.

DESCRIPTION OF THE PREFERRED EMBODIMENTS

Figure 1:
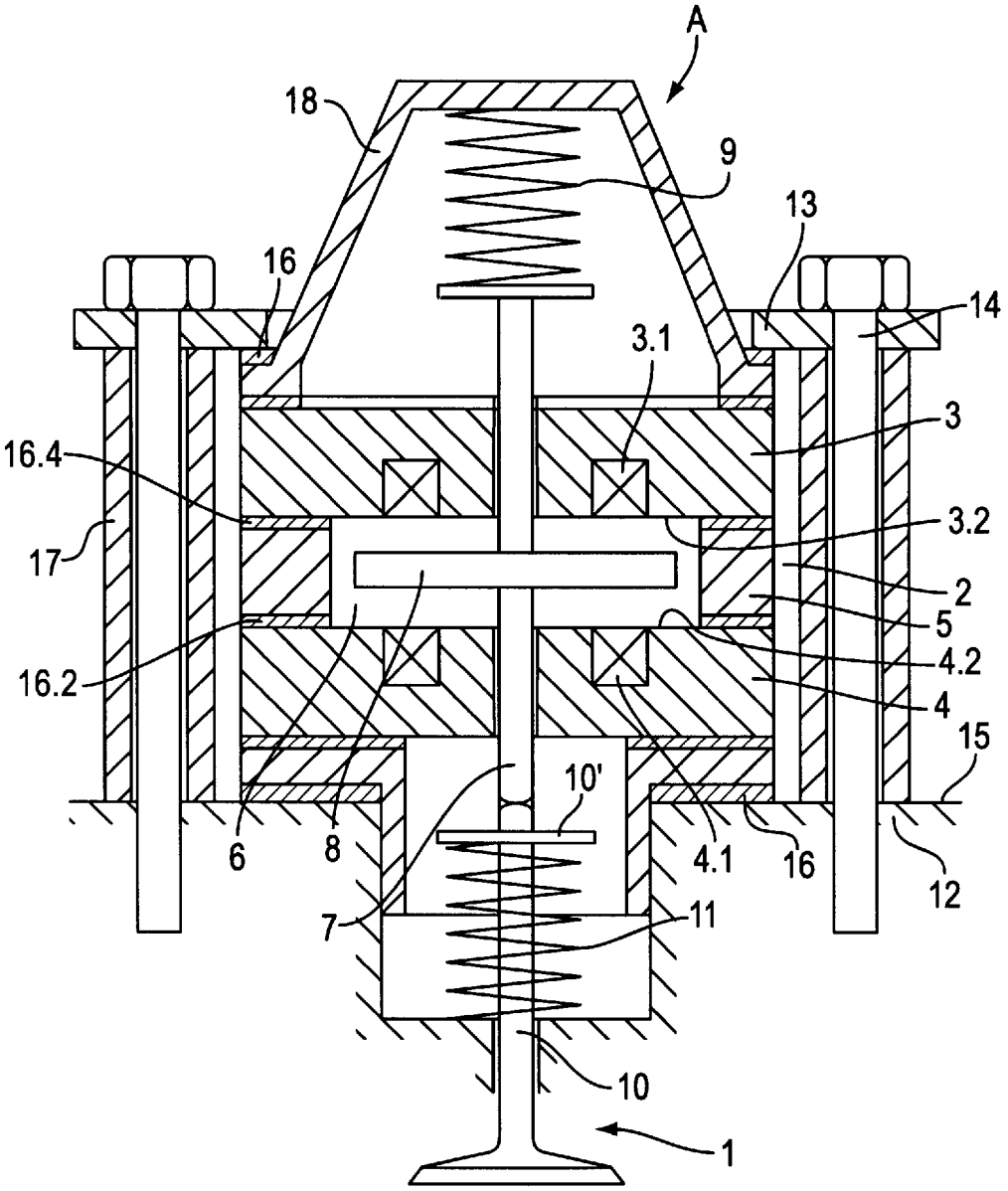
FIG. 1 is an axial sectional view of an electromagnetic actuator according to a preferred embodiment of the invention, adapted for an upstanding mounting.

FIG. 1 shows an electromagnetic actuator generally designated at A for operating a cylinder valve 1. The actuator A is essentially composed of a magnet block 2 formed of an upper electromagnet 3, a lower electromagnet 4 and a spacer 5 disposed therebetween. The two electromagnets 3 and 4 have a respective magnet coil 3.1 and 4.1 connected with a non-illustrated current supply. An armature 8 is disposed in the intermediate space 6 maintained free by the spacer 5 and is affixed to a guide rod 7. At its upper end the guide rod 7 is supported on the inside of a housing part 18 with the intermediary of a resetting spring 9 functioning as an opening spring and at the lower end the guide rod 7 abuts the terminus of the stem 10 of the cylinder valve 1. The valve stem 10 carries a support disk 10' which is engaged by a valve closing spring 11 which simultaneously serves as the lower resetting spring. In case of an alternating energization of the electromagnets 3 and 4, the armature 8 is reciprocated between the two electromagnets and, in accordance with a predetermined control of the energization of the two electromagnets 3 and 4, the cylinder valve 1 is opened and closed. FIG. 1 shows the actuator in a deenergized state. According to the embodiment illustrated in FIG. 1, the magnet block 2 is mounted upright on an upwardly oriented surface 15 of a cylinder head 12 of an internal-combustion engine. The securement is effected by means of a clamping yoke 13 and at least two tightening bolts 14 which are screwed into corresponding threaded bores provided in the cylinder head 12.

Since during operation, in response to an energization of the electromagnets 3 and 4 the armature 8 alternatingly abuts the pole faces 3.2 and 4.2 of the respective electromagnets 3 and 4 with an impact speed which results in a sound generation, according to the invention a sound insulation is provided. To effect a sound insulation between the clamping yoke 13 and the engagement face 15 of the cylinder head 12, sound muffling means 16 formed of a rubber-elastic intermediate layer is provided. By such a sound muffling arrangement a transmission of the impact sound generated upon the collision of the armature with the respective pole face is reduced and, as a result, sound transmission to the internal-combustion engine and components connected therewith also diminishes.

To prevent the sound muffling means 16 from being excessively compressed upon tightening of the bolts 14 and thus risking a loss of the sound muffling properties, between the clamping yoke 13 and the engagement face 15 of the cylinder head 2 spacer tubes 17 are provided so that regardless of the magnitude of the tightening torque applied to the bolts 14, the rubber-elastic sound muffling means 16 will not be excessively compressed. As seen in FIG. 1, the support 18 for the resetting spring 9 is also sound-insulated from the clamping yoke 13 so that the armature 8 and the resetting spring 9 too, can practically not transmit any sound by body vibration.

In addition to the two sound muffling means 16 which are directly associated with the securing means for the actuator, it is feasible to provide, as also shown in FIG. 1, sound muffling means 16.1 and 16.2 between the two electromagnets 3 and 4 and the associated spacer 5 so that the sound insulating effect is further increased.

Figure 2:
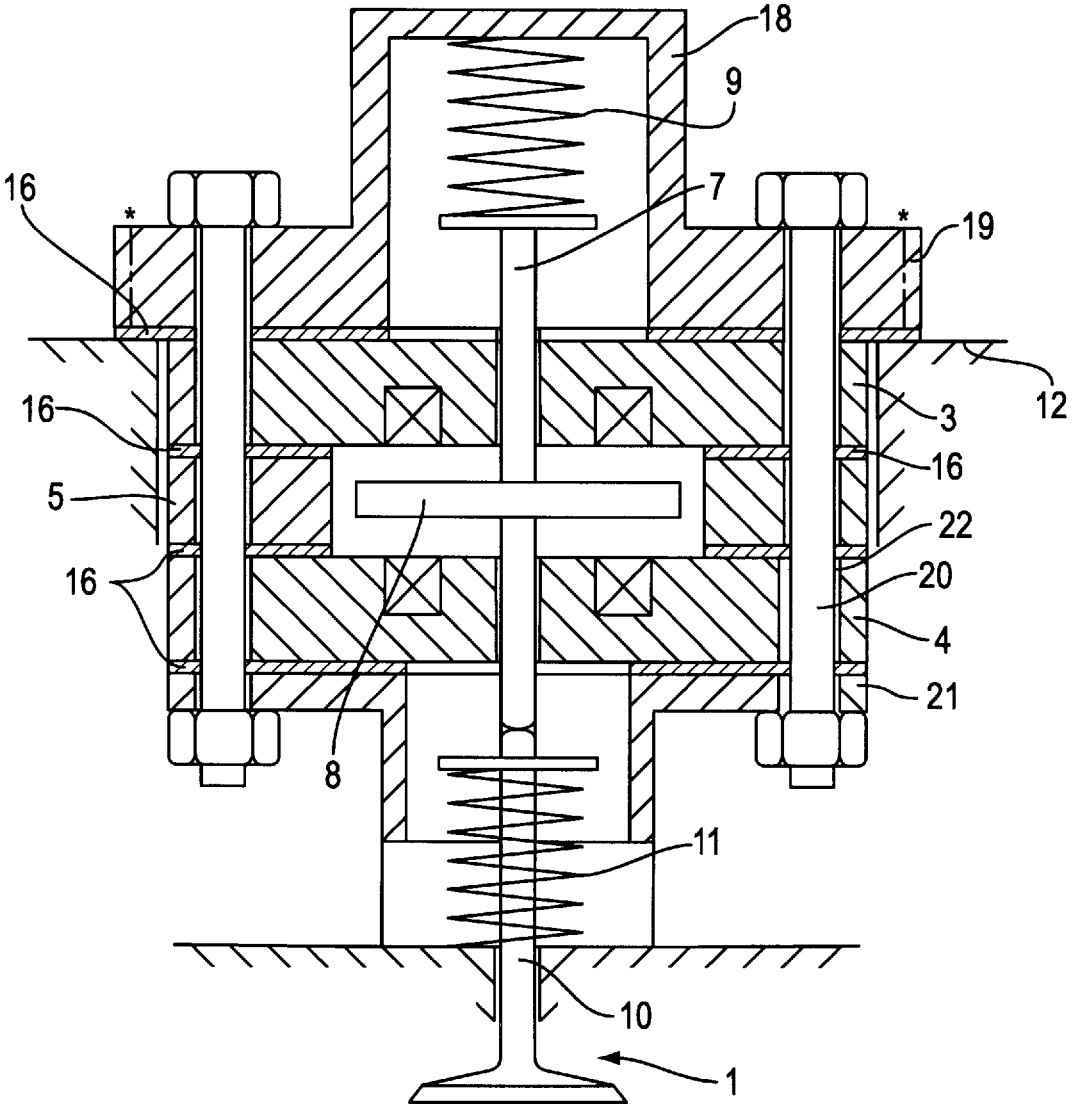
FIG. 2 is an axial sectional view of an electromagnetic actuator according to another preferred embodiment of the invention, adapted for a suspended mounting.

The embodiment illustrated in FIG. 2 is in principle of the same construction as the arrangement shown in FIG. 1. The difference resides in that the actuator as a whole is suspended, that is, the magnet block is, with the clamping yoke 13, clamped together as a structural element with the interposition of a sound muffling means 16 and is ready to be installed. The actuator is, by means of lateral extensions 19, attached by bolts at the clamping yoke 13 to the cylinder head 12 from which the entire unit is suspended and is received in a cylinder head well. Between the individual elements again, rubber-elastic intermediate layers (sound muffling means) 16 are provided.

The structure according to FIG. 1 may be configured in the same manner as the structure of FIG. 2 in which the individual elements, that is, the clamping yoke 13, the upper electromagnet 3, the spacer 5, the lower electromagnet 4 and a base plate 21 are clamped together by means of at least two throughgoing connecting bolts 20.

Figure 3:
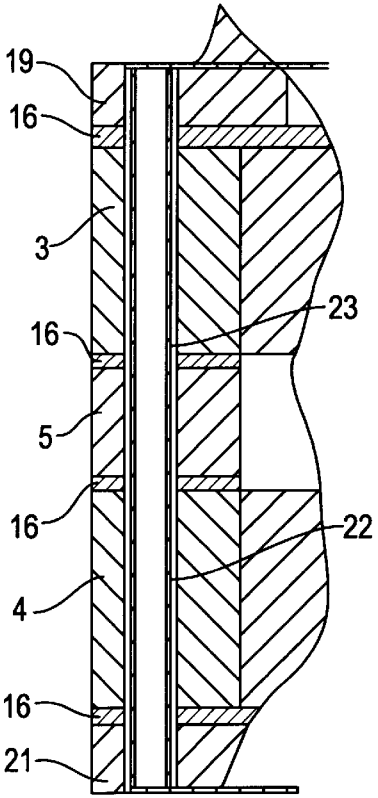
FIG. 3 is a fragmentary axial sectional view of a magnet block without clamping means.

In the embodiment illustrated in FIG. 3, the throughgoing series of aligned bores 22 provided in the individual elements accommodates a spacer tube 23 which serves for receiving a connecting bolt 20 and which has a length that is slightly less than the overall height of the loosely superposed magnet block. The inner diameter of the bores 22 is slightly greater than the outer diameter of the spacer tube 23 so that the spacer tube 23 is, over its entire length, out of immediate contact with the individual elements.

Figure 4:
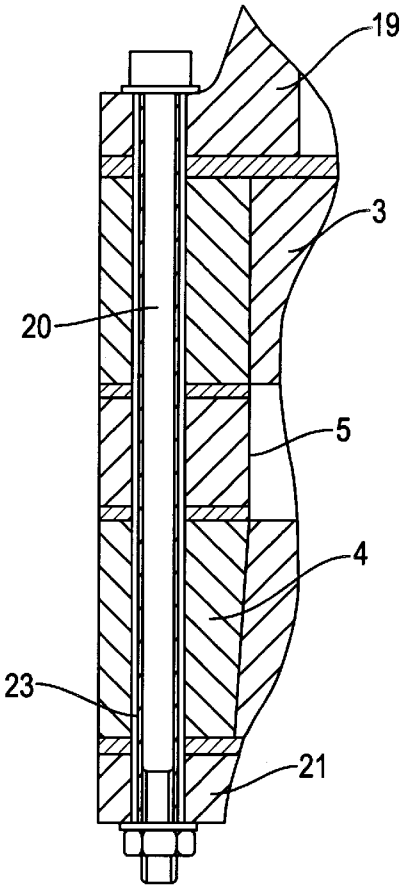
FIG. 4 is a view similar to FIG. 3, showing the magnet block with clamping means.

If, as shown in FIG. 4, the individual elements are clamped to one another by means of the connecting bolts 20, the stack composed of the individual elements and the sound muffling means 16 positioned therebetween may be compressed only to the extent that equals the predetermined difference between the lesser length of the spacer tube 23 and the structural height of the unclamped stack.

To ensure that the armature 8 is guided satisfactorily in its reciprocating motion on the guide rod 7, expediently means for centering the individual elements of the magnet block are provided. The centering means, while allowing the necessary, although slight relative motions in the direction of armature displacement, reliably prevent any transverse motion of the individual elements of the magnet blocks.

Figure 5:
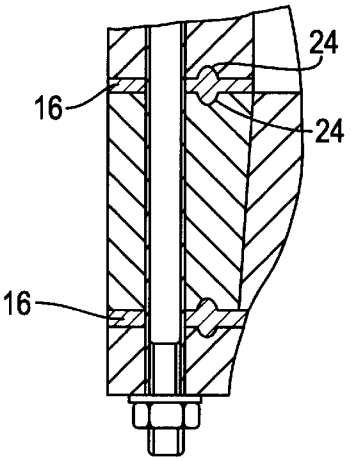
FIG. 5 is a fragmentary axial sectional view of a magnet block showing centering means according to a first variant.

As shown in FIG. 5, such a centering may be effected by projections 24 which are formed on the sound muffling means 16 and which extend into corresponding grooves of the associated individual magnet block element.

Figure 6:
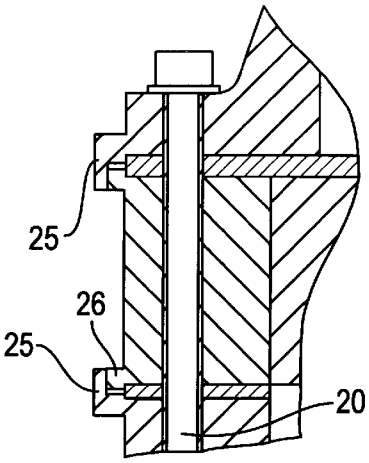
FIG. 6 is a view similar to FIG. 5, showing a second variant.

Instead of the above-noted projections or in addition to such projections, it is further feasible, as shown in FIG. 6, to provide the individual magnet block elements with interlocking projections 25 at their outer periphery. Even if practically no transverse clearance is present between the projection 25 and the associated counterface 26 at the circumference of the adjoining individual element, such a connection nevertheless is sufficient as an isolation to reliably prevent or at least significantly reduce sound transmission by body vibration.

Sound muffling means 16 may be provided in a similar manner in an electromagnetic actuator which has only a single electromagnet. When using such an actuator for operating a cylinder valve, the armature is moved into one position, for example, the "valve closed" position by a resetting spring, and is moved into the "valve open" position by energizing the electromagnet and causing displacement of the armature against the force of the resetting spring. Such an actuator in principle corresponds to the earlier-described embodiments from which one of the two magnets is omitted. For the earlier-described operational mode this would mean that in the described embodiments the upper magnet may be omitted so that the clamping yoke 13 holds directly the lower magnet 4 with the intermediary of a spacer 5.

It will be understood that the above description of the present invention is susceptible to various modifications, changes and adaptations, and the same are intended to be comprehended within the meaning and range of equivalents of the appended claims.

What is claimed is:

1. A combination of an internal combustion engine and an electromagnetic actuator; the engine comprising a cylinder valve, a mounting surface and mounting means for attaching said electromagnetic actuator to said mounting surface; said electromagnetic actuator comprising (a) an electromagnet for generating an attracting electromagnetic force when energized;

(b) an armature movable into contact with and away from said electromagnet; said armature being connected to said valve for displacing said valve upon movement of said armature;

(c) spring means connected to said armature for opposing the electromagnetic force; and (d) sound muffling means attached to said electromagnet for reducing sound transmission by body vibration from said electromagnet.

2. The electromagnetic actuator as defined in claim 1, wherein said sound muffling means is disposed between said electromagnet and said mounting surface.

3. The electromagnetic actuator as defined in claim 1, wherein said sound muffling means comprises a layer formed of a temperature-resistant material having rubber-elastic properties.

4. A combination of an internal combustion engine and an electromagnetic actuator; the engine comprising a cylinder valve, a mounting surface and mounting means for attaching said electromagnetic actuator to said mounting surface; said electromagnetic actuator comprising (a) a magnet block having opposite ends and including (1) an electromagnet for generating an attracting electromagnetic force when energized; and (2) a spacer being in engagement with said electromagnet and defining a space adjoining said electromagnet;

(b) clamping means for tightening said electromagnet and said spacer together; said clamping means including clamping elements engaging said magnet block at said opposite ends thereof;

(c) an armature disposed and movable in said space into contact with and away from said electromagnet; said armature being connected to said valve for displacing said valve upon movement of said armature;

(d) spring means connected to said armature for opposing said electromagnetic force; and (e) sound muffling means disposed between said clamping elements and said electromagnet for reducing sound transmission by body vibration from said magnet block.

5. The electromagnetic actuator as defined in claim 4, wherein said sound muffling means is tightened to said magnet block by said clamping means.

6. The electromagnetic actuator as defined in claim 5, further comprising compression limiting means for limiting an extent of compression of said sound muffling means by said clamping means.

7. The electromagnetic actuator as defined in claim 6, wherein said clamping means comprises a tightening bolt and further wherein said limiting means comprises a spacer tube extending along said magnet block and being at a clearance therefrom; said tightening bolt passing through said spacer tube.

8. The electromagnetic actuator as defined in claim 4, wherein said sound muffling means is disposed between said magnet block and said mounting surface.

9. A combination of an internal combustion engine and an electromagnetic actuator; the engine comprising a cylinder valve, a mounting surface and mounting means for attaching said electromagnetic actuator to said mounting surface; said electromagnetic actuator comprising (a) a magnet block having opposite ends and including (1) a first electromagnet for generating an attracting electromagnetic force when energized;

(2) a second electromagnet for generating an attracting electromagnetic force when energized; and (3) a spacer disposed between said first and second electromagnets for defining a space therebetween;

(b) clamping means for tightening said first and second electromagnets and said spacer together; said clamping means including clamping elements engaging said magnet block at said opposite ends thereof;

(c) an armature disposed and movable in said space into contact with and away from said first and second electromagnets; said armature being connected to said valve for displacing said valve upon movement of said armature;

(d) spring means connected to said armature for opposing said electromagnetic force; and (e) sound muffling means disposed between said clamping elements and said first and second electromagnets for reducing sound transmission by body vibration from said magnet block.

10. The electromagnetic actuator as defined in claim 9, further comprising centering means for aligning said first and second electromagnets and for preventing relative displacements thereof in a direction transverse to a direction of motion of said armature.

11. The electromagnetic actuator as defined in claim 10, wherein said centering means includes means for allowing relative displacements of said first and second electromagnets in a direction parallel to said direction of motion of said armature.

12. The electromagnetic actuator as defined in claim 9, wherein said sound muffling means is disposed between said magnet block and said mounting surface.

* * * * *